US011804324B2

(12) United States Patent
Kim et al.

(10) Patent No.: US 11,804,324 B2
(45) Date of Patent: Oct. 31, 2023

(54) COIL COMPONENT AND METHOD FOR MANUFACTURING THE SAME

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 915 days.

(21) Appl. No.: 16/285,959

(22) Filed: Feb. 26, 2019

(65) Prior Publication Data

US 2020/0027643 A1 Jan. 23, 2020

(30) Foreign Application Priority Data

Jul. 18, 2018 (KR) ..... 10-2018-0083388

(51) Int. Cl.

| | |
|---|---|
| ***H01F 27/28*** | (2006.01) |
| ***H01F 27/32*** | (2006.01) |
| ***H01F 41/12*** | (2006.01) |
| ***H01F 41/04*** | (2006.01) |

(52) U.S. Cl.

CPC ..... *H01F 27/2804* (2013.01); *H01F 27/323* (2013.01); *H01F 41/041* (2013.01); *H01F 41/122* (2013.01); *H01F 2027/2809* (2013.01)

(58) Field of Classification Search

CPC .. H01F 27/2804; H01F 27/323; H01F 41/041; H01F 41/122; H01F 2027/2809; H01F 27/292; H01F 2017/048; H01F 41/046; H01F 17/0013; H01F 27/28;

(Continued)

(56) References Cited

U.S. PATENT DOCUMENTS 9,899,136 B2 2/2018 Lee et al.
2015/0102889 A1* 4/2015 Choi ..... H01F 27/292 336/200

(Continued)

FOREIGN PATENT DOCUMENTS

CN 105609267 A 5/2016
CN 107039155 A 8/2017

(Continued)

OTHER PUBLICATIONS

Office Action issued in Korean Patent Application No. 10-2018-0083388 dated Aug. 21, 2019, with English translation.

(Continued)

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes a body including a coil having a top coil and a bottom coil connected to each other through a via and an external electrode disposed on an external surface of the body to be connected to the coil. A first insulating layer is disposed on a surface of the top coil, and a second insulating layer is disposed on a surface of the bottom coil. The first and second insulating layers are disposed to extend between the top coil and the bottom coil.

12 Claims, 6 Drawing Sheets

(58) Field of Classification Search
CPC .... H01F 27/324; H01F 41/042; H01F 41/125; H01F 2017/002
USPC ..... 336/192, 232, 198, 200
See application file for complete search history.

(56) References Cited

U.S. PATENT DOCUMENTS

| | | | | |
|---|---|---|---|---|
| 2015/0155093 | A1* | 6/2015 | Kim | H01F 41/046 156/314 |
| 2016/0141102 | A1 | 5/2016 | Tseng et al. | |
| 2017/0032884 | A1* | 2/2017 | Choi | H01F 41/046 |
| 2017/0162317 | A1* | 6/2017 | Taniguchi | H01F 41/046 |
| 2017/0194084 | A1 | 7/2017 | Choi et al. | |
| 2017/0236633 | A1* | 8/2017 | Park | H01F 17/04 336/55 |
| 2017/0287621 | A1 | 10/2017 | Seino et al. | |
| 2017/0330674 | A1 | 11/2017 | Lee et al. | |
| 2017/0372832 | A1* | 12/2017 | Choi | H01F 27/2804 |
| 2018/0197672 | A1 | 7/2018 | Kim et al. | |
| 2018/0308612 | A1* | 10/2018 | Park | H01F 27/292 |
| 2018/0366246 | A1* | 12/2018 | Park | H01F 27/29 |
| 2018/0374626 | A1* | 12/2018 | Jang | H01F 27/323 |
| 2019/0189338 | A1* | 6/2019 | Kim | H01F 27/324 |

FOREIGN PATENT DOCUMENTS

| | | | |
|---|---|---|---|
| CN | 107275059 | A | 10/2017 |
| CN | 107369536 | A | 11/2017 |
| CN | 108281261 | A | 7/2018 |
| JP | 2005-317604 | A | 11/2005 |
| KR | 10-1999-0066108 | A | 8/1999 |
| KR | 10-2017-0127927 | A | 11/2017 |
| KR | 10-2018-0017409 | A | 2/2018 |
| KR | 10-2018-0025592 | A | 3/2018 |

OTHER PUBLICATIONS

Chinese Office Action dated Feb. 11, 2022, issued in corresponding Chinese Patent Application No. 201910480156.7 (with English translation).
Chinese Office Action dated Aug. 10, 2022, issued in corresponding Chinese Patent Application No. 201910480156.7.

* cited by examiner

COIL COMPONENT AND METHOD FOR MANUFACTURING THE SAME

CROSS-REFERENCE TO RELATED APPLICATION(S)

This application claims benefit of priority to Korean Patent Application No. 10-2018-0083388 filed on Jul. 18, 2018 in the Korean Intellectual Property Office, the disclosure of which is incorporated herein by reference in its entirety.

BACKGROUND

1. Field

The present disclosure relates to a coil component and a method for manufacturing the same, and more particularly, to a power inductor and a method for manufacturing the same.

2. Description of Related Art

As the miniaturization and thinning of various electronic devices have accelerated with the development of information technology (IT) devices, inductors used in electronic devices have also been required to be miniaturized and thinned.

To achieve miniaturization of an inductor while retaining the same level of performance, there is a need to increase the number of turns of a coil pattern and to increase an aspect ratio (AR) of a coil.

SUMMARY

An aspect of the present disclosure is to provide an inductor in which a thickness of a coil is increased within a limited low-profile chip thickness, and a method for manufacturing the inductor.

According to an aspect of the present disclosure, a coil component includes a body including a coil including a top coil and a bottom coil connected to each other through a via and an external electrode disposed on an external surface of the body to be connected to the coil. A first insulating layer is disposed on a surface of the top coil, and a second insulating layer is disposed on a surface of the bottom coil. The first and second insulating layers are disposed to extend between the top coil and the bottom coil.

The first and second insulating layers may be integrated as a single body between the top coil and the bottom coil.

One or more of a thickness of the first insulating layer and a thickness of the second insulating layer may be greater than half of a distance between the top coil and the bottom coil.

The first and second insulating layers may forma boundary, on which the first and second insulating layers are in contact with each other, between the top coil and the bottom coil.

The first insulating layer may have a thickness smaller than half a distance between the top coil and the bottom coil, and the second insulating layer may have a thickness smaller than half of the distance between the top coil and the bottom coil.

A pore may be formed on or beneath the boundary.

Each of the first insulating layer and the second insulating layer may have a thickness of 5 micrometers or more to 15 micrometers or less.

A space between the top coil and the bottom coil may not include an insulating material other than an insulating material forming the first insulating layer and the second insulating layer.

According to an aspect of the present disclosure, a method for manufacturing a coil component may include preparing an insulating film, processing a via hole penetrating through the insulating film, disposing a conductive layer along surfaces of the insulating film including a top surface and a bottom surface of the insulating film and the via hole, disposing a patterned insulating wall on the conductive layer, filling an opening of the patterned insulating wall with a plating layer, removing the insulating wall and the conductive layer disposed between the insulating wall and the insulating film, removing the insulating film, and forming an insulating layer to cover an entire exposed surface.

The insulating film may have a thickness of 30 micrometers or less.

The removing the insulating film may include dissolving the insulating film using a solvent.

The insulating layer covering a surface of an upper conductive layer may have the same thickness as the insulating layer covering a surface of a lower conductive layer.

The insulating layer covering a surface of an upper conductive layer and the insulating layer covering a surface of a lower conductive layer may integrated into a body in a void in which the insulating film is removed.

The insulating film may be in a state in which curing is completed.

The removing the insulating wall may be performed using a $CO_2$ laser.

The method may further include compressing an upper conductive layer and a lower conductive layer, disposed at an upper portion and a lower portion on the basis of a void in which the insulating layer is removed, respectively, toward the void after forming the insulating layer to cover the entire exposed surface.

According to an aspect of the present disclosure, a coil component includes a body including a top coil and a bottom coil connected to each other through a via, and an insulating layer including a first insulating layer that directly contacts bottom and side surfaces of the top coil, and a second insulating layer that directly contacts top and side surfaces of the bottom coil. The insulating layer integrally extends from the bottom surface of the top coil to the top surface of the bottom coil.

The top coil may include a seed layer disposed along the bottom surface of the top coil, and a plating layer disposed above the seed layer of the top coil. The seed layer may extend integrally along the via and a top surface of the bottom coil. The plating layer may extend integrally to the bottom coil through the via and below the seed layer of the bottom coil.

The first insulating layer may integrally extend between windings of the top coil, and the second insulating layer may integrally extend between windings of the bottom coil.

The coil component may further include first and second external electrodes each connected to a respective one of the top and bottom coils, and an encapsulant, including a magnetic material, disposed between the insulating layer and the first and second external electrodes.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
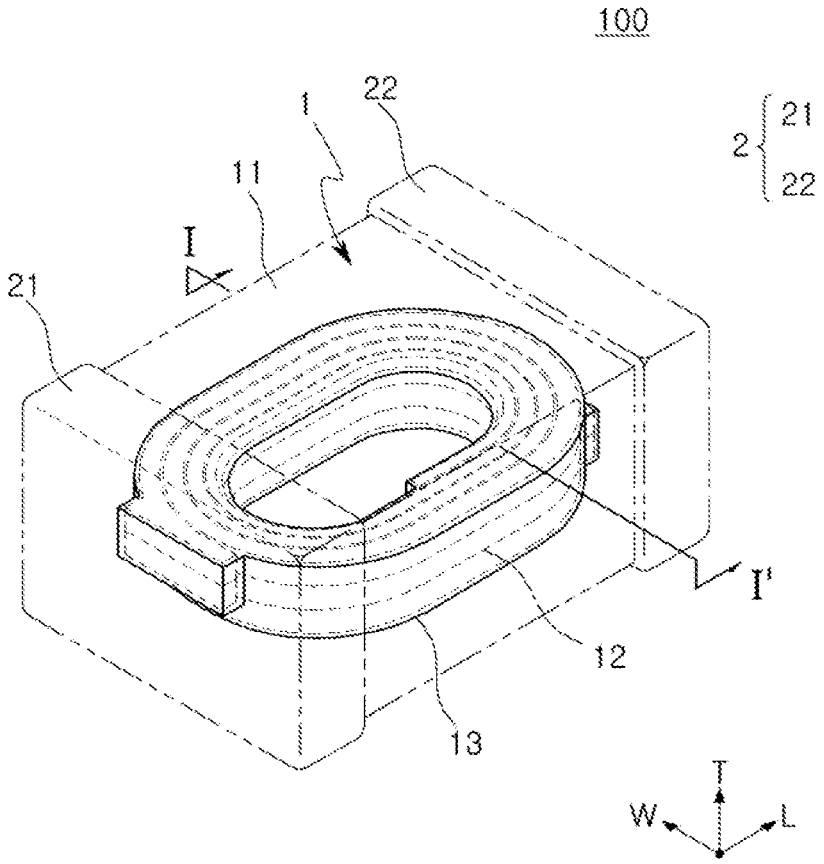
FIG. 1 is a perspective view of a coil component according to an exemplary embodiment in the present disclosure.

Hereinafter, examples of the present disclosure will be described as follows with reference to the attached drawings.

The present disclosure may, however, be embodied in many different forms and should not be construed as being limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

It will be understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Hereinafter, a coil component and a method for manufacturing the same will be described, but are not limited thereto.

Coil Component

Figure 2:
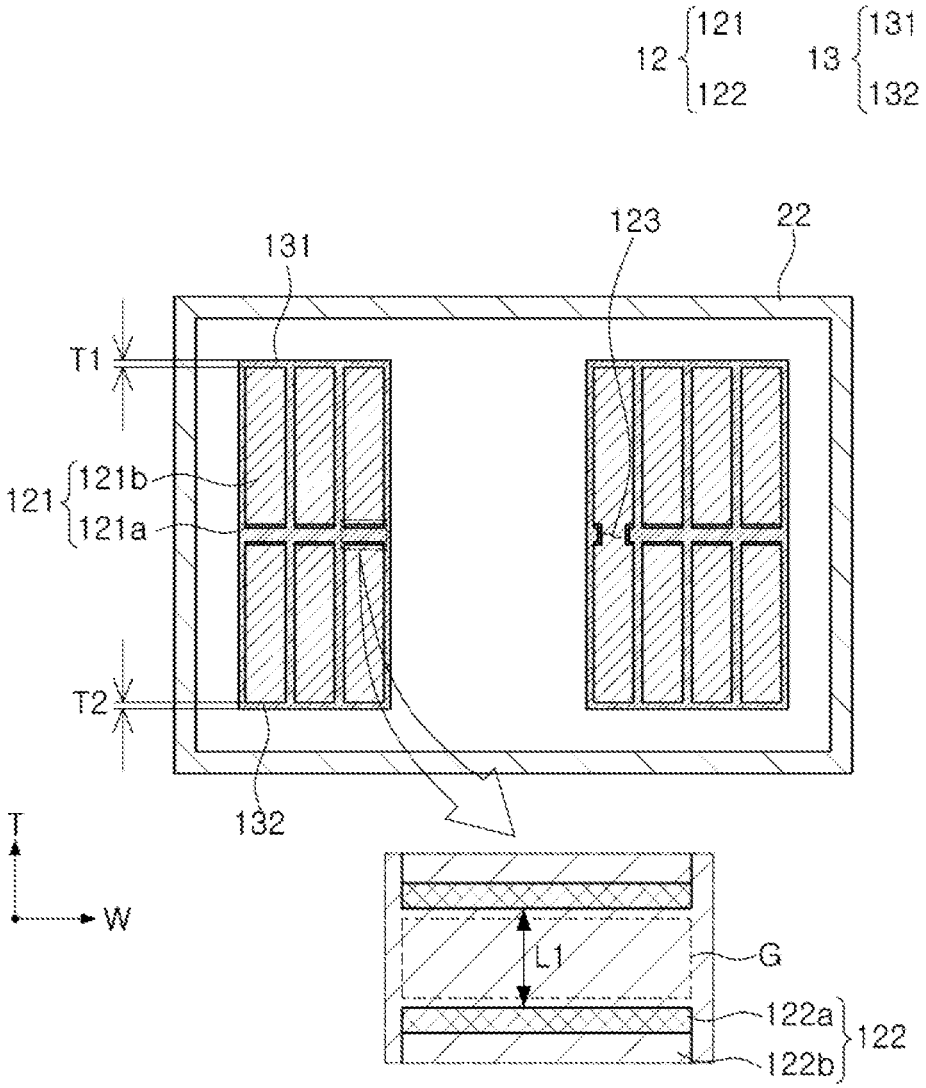
FIG. 2 is a cross-sectional view taken along line I-I' in FIG. 1.

FIG. 1 is a perspective view of a coil component according to an exemplary embodiment in the present disclosure, and FIG. 2 is a cross-sectional view taken along line I-I' in FIG. 1.

Referring to FIGS. 1 and 2, a coil component 100 according to an exemplary embodiment includes a body 1 and an external electrode 2 disposed on an external surface of the body 1.

The external electrode 2 includes a first external electrode 21 and a second external electrode 22 which operate in polarities opposite to each other and are disposed to oppose each other. The first and second external electrodes 21 and 22 are implemented in a 'C' shape in FIG. 1, but are not limited thereto. For example, the shape of each of the first and second external electrodes 21 and 22 may be changed to an 'L' shape, a bottom electrode shape disposed only on a bottom surface, or the like. Each of the first and second external electrodes 21 and 22 may include a plurality of layers, and may include nickel (Ni) layer-tin (Sn) layer, a layer containing an epoxy resin, or the like, among the plurality of layers.

The body 1 may form an appearance of the coil component 100 and may have a substantially hexahedral shape having a first end surface and a second end surface, disposed to oppose each other in a length direction L, a first side surface and a second side surface, disposed to oppose each other in a width direction W, and a top surface and a bottom surface disposed to oppose each other in a thickness direction T.

The body 1 includes an encapsulant 11 formed of a magnetic material having magnetic properties. The magnetic material may be, for example, a ferrite, or a material in which metal magnetic particles fill in a resin. The metal magnetic particles may be appropriately combined in consideration of the properties required by those skilled in the art and may include at least one selected from the group consisting of iron (Fe), silicon (Si), chromium (Cr), aluminum Al, and nickel Ni.

A coil 12 is filled with the encapsulant 11 of the body 1.

The coil 12 has a spiral shape, and a top coil 121 and a bottom coil 122 are connected to each other through a via 123. A thickness of the via 123 is substantially the same as an interval at which the top coil 121 and the bottom coil 122 are spaced apart from each other in a thickness direction. For example, the via 123 has a thickness of, in detail, 30 micrometers (μm) or less. An insulating layer may be filled to be coplanar with the via 123, and an insulation between the top coil 121 and the bottom coil 122 may be implemented by the insulating layer. In the case of the present disclosure, other than the insulating layer disposed to be coplanar with the via, a separate support member, a separate substrate, or the like is not included. For example, a separate support member or a separate substrate, distinguished from the insulating layer, may be an insulating film such as a copper clad laminate (CCL) substrate, an Ajinomoto Build-up Film (ABF), or the like, and may collectively be referred to as a "member" included to form and support a coil by those skilled in the art.

The top coil 121 is connected to the first external electrode 21, and the bottom coil 122 is connected (e.g., directly connected) to the second external electrode 22.

A cross-sectional shape, based on an L-T plane of the coil 12, is a substantially rectangular shape. In this case, the substantially rectangular shape may correspond to all of a case in which a top surface of a coil is flat, a case in which a top surface of a coil is convex or concave, and the like. The cross-sectional shape may be easily changed by adjusting a concentration of plating liquid, a plating time, and a plating rate for formation of a coil. Similarly to a method to be described later, to form a cross section of a coil to have a shape similar to a rectangle, when a process of filling an opening with a plating liquid is performed after a patterned insulating wall is prepared to have the opening, the coil may be grown to have a uniform cross-sectional shape in the thickness direction.

The top coil 121 and the bottom coil 122 include a first metal layer and a second metal layer, respectively. A first metal layer 121*a* of the top coil 121 serves as a seed layer for forming a second metal layer 121*b*, and a first metal layer 122*a* of the bottom coil 122 serves as a seed layer to form a second metal layer 122*b*. The top and bottom coils 121 and 122 may further include an additional metal layer in addition to the first and second metal layers, and the additional metal layer may be formed using anisotropic plating, isotropic plating, or the like.

An insulating layer 13 is disposed on a surface of the coil 12. The insulating layer includes a first insulating layer 131, disposed to cover a surface of the top coil 121, and a second insulating layer 132 disposed to cover a surface of the bottom coil 122. In detail, the first and second insulating layers 131 and 132 are formed of the same material. As described later, this is because bonding between the same physical properties is improved when the first and second insulating layers 131 and 132 are in contact with each other to fill a space G between the top coil and the bottom coil.

In detail, the first insulating layer 131 has a thickness of 5 μm or more to 15 μm or less. Similarly, the second insulating layer 132 has a thickness of 5 μm or more to 15 μm or less.

When each of the first and second insulating layers has a thickness less than 5 μm, it is technically difficult to form a uniform insulating layer. When loss of the insulating layer occurs in some sections, short-circuiting may occur. Meanwhile, when each of the first and second insulating layers has a thickness greater than 15 μm, the thickness of the insulating layer may prevent the thickness of the coil from increasing within a size of a miniaturized chip.

When the first and second insulating layers 131 and 132 have insulating properties, they may be applied without limitation, but it is unnecessary to include a separate filler. A typical epoxy resin or polyimide resin may be applied to the first and second insulating layers 131 and 132 without limitation. However, when a chemical vapor deposition (CVD) process is applied to implement a uniform and thin insulating film, a perylene resin may be appropriate.

While the first insulating layer 131 is disposed on the surface of a top coil, the first insulating layer 131 is disposed to extend to the space G between the top coil and the bottom coil. As a result, the first insulating layer 131 has a shape covering an external lower corner portion of an outermost coil pattern in the top coil and covering an internal lower corner portion of an innermost coil pattern in the top coil. A related-art coil component is distinguished in that a separate support member supports a bottom surface of a lower corner portion of innermost and outermost coil patterns in a top coil.

Similarly, while the second insulating layer 132 is disposed on the surface of the bottom coil, the second insulating layer 132 is disposed to extend to the space G between the top coil and the bottom coil. As a result, the second insulating layer 132 has a shape covering an external upper corner portion of an outermost coil pattern in the bottom coil and covering an internal upper corner portion of an innermost coil pattern in the bottom coil.

Referring to FIG. 2, the first and second insulating layers 131 and 132 may be integrated as a single body in the space G between the top coil and the bottom coil.

The first and second insulating layers 131 and 132 are integrated with each other such that a boundary therebetween may not be readily apparent A thickness of the space G is equal to an interval L1 or distance between the top coil and the bottom coil.

A thickness T1 of the first insulating layer 131 refers to a straight distance from the top surface of the top coil to the surface of the first insulating layer, and the thickness T1 is greater than half the interval L1. Similarly, a thickness T2 of the second insulating layer 132 refers to a straight distance from the bottom surface of the bottom coil to the surface of the second insulating layer, and the thickness T2 is greater than half the interval L1.

When the thicknesses T1 and T2 of the first and second insulating layers 131 and 132 and the interval L1 have the above-described thickness range, the first and second insulating layers 131 and 132 are integrated as a single body without a boundary therebetween.

Figure 3:
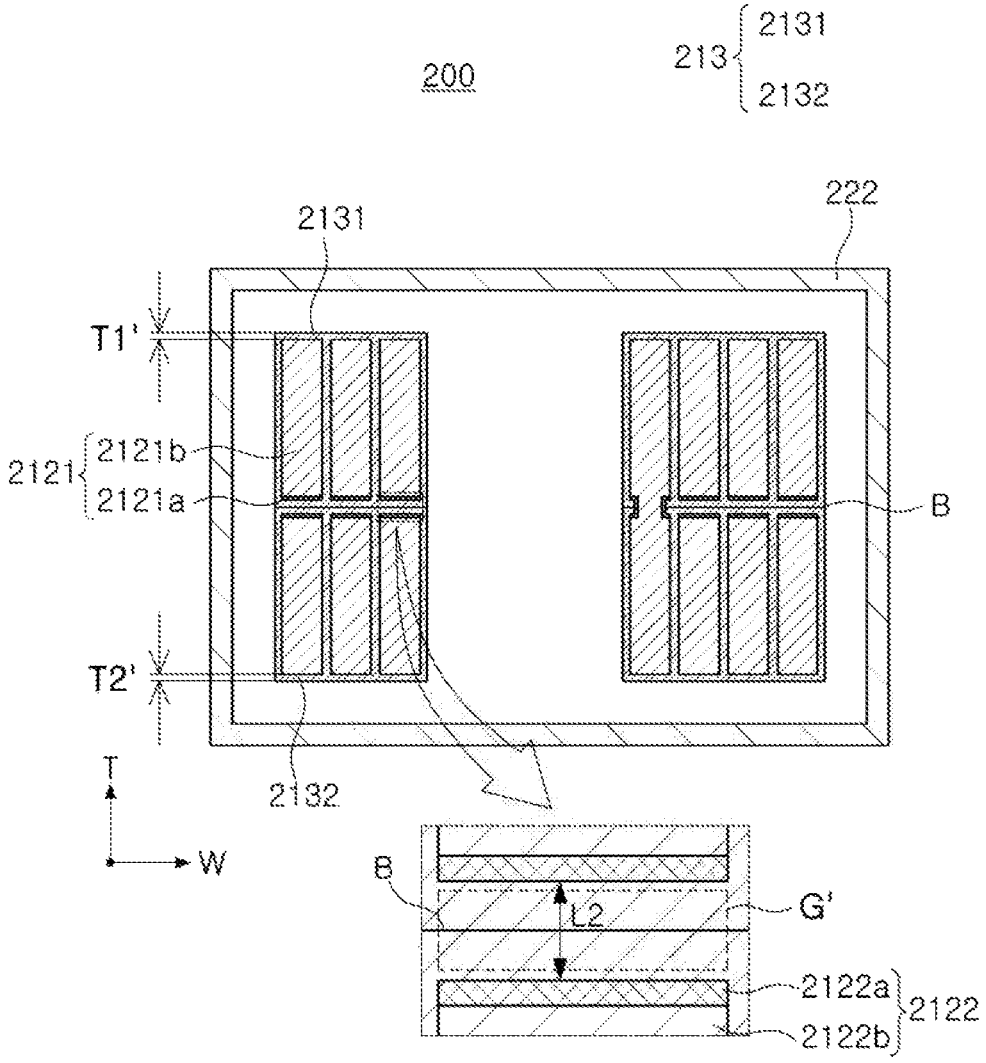
FIG. 3 is a cross-sectional view of a coil component according to a modified embodiment of FIG. 2.

FIG. 3 a cross-sectional view of a coil component 200 according to a modified embodiment of the coil component 100 in FIGS. 1 and 2. As compared to the coil component 100, illustrated in FIGS. 1 and 2, in which the first and second insulating layers 131 and 132 are integrated with each other without a boundary therebetween, the coil component 200 illustrated in FIG. 3 has a boundary B formed between a first insulating layer 2131 and a second insulating layer 2132. For ease of description, only contents different from those of the coil component 100 of FIGS. 1 and 2 will be described, and duplicate descriptions will be omitted.

Referring to FIG. 3, a boundary is formed on a surface, on which the first insulating layer 2131 and the second insulating layer 2132 are in contact with each other, in a space G' between a top coil 2121 and a bottom coil 2122. The boundary collectively refers to a surface capable of distinguishing one case, in which the first insulating layer corresponds to an insulating layer covering a surface of the top coil, from another case, in which the second insulating layer corresponds to an insulating layer covering a surface of the bottom coil. In detail, a case, in which a pore is observed around a surface on which the first insulating layer and the second insulating layer are in contact with each other, is included.

When a boundary B is formed in the space G', a thickness T1' of the first insulating layer 2131 is smaller than half an interval L2 at or distance by which a top coil and a bottom coil are spaced apart from each other (e.g., L2 is a thickness of the space G' between top and bottom coils), and a thickness T2' of the second insulating layer 2132 is smaller than half the interval L2.

FIGS. 4A to 4I illustrate a method for manufacturing a coil component according to another exemplary embodiment in the present disclosure. A method for manufacturing the above-described coil components 100 and 200 is not limited to the manufacturing method to be described below, which is merely an example of a method for manufacturing a coil component according to an exemplary embodiment.

Figure 4A:
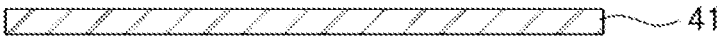
FIGS. 4A to 4I illustrate sequential steps of a method for manufacturing a coil component according to another exemplary embodiment in the present disclosure.

Referring to FIG. 4A, an insulating film 41 is prepared. The insulating film 41 has a shape of a thin plate formed of an insulating material. In detail, the insulating film 41 has a thickness of about 30 μm. In further detail, the insulating film 41 has a thickness of 30 μm or less depending on a scale-down trend. When the number of turns and a thickness of a coil formed on the insulating film 41 are not significant, the thickness of the coil may be decreased to about 20 μm. In detail, the insulating film 41 is in a state in which curing thereof is completed. When the coil is formed on the insulating film 41, the insulating film 41 may stably support the coil due to the curing. When the insulating film 41 is dissolved using a solvent after the curing, the remaining insulating film may be significantly reduced.

Figure 4B:
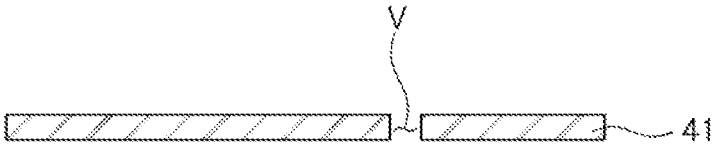

Referring to FIG. 4B, a via hole 'v' is processed. A manner of processing the via hole 'v' is not limited and may be undertaken using a $CO_2$ laser. A detailed cross-sectional shape of the via hole 'v' may be a circular shape, a tapered shape, or the like, which may be appropriately selected by those skilled in the art.

Figure 4C:
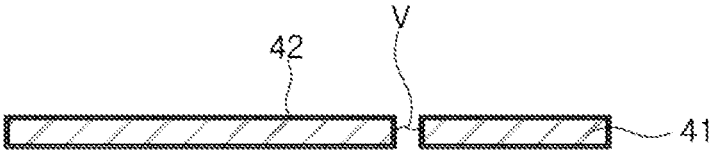

Referring to FIG. 4C, a conductive layer 42 is disposed to cover the entire exposed surface of the insulating film 41 including a surface of the via hole 'v'. A manner of disposing the conductive layer 42 is not limited, and electroless plating, sputtering, or the like may be applied without limitation. It is a matter of course that the conductive layer includes a conductive material, and an appropriate metal material may be selected depending on a detailed forming method thereof.

Figure 4D:
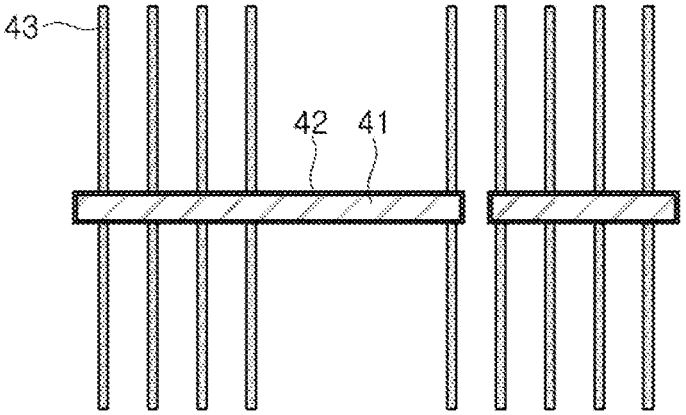

Referring to FIG. 4D, a patterned insulating wall 43 is disposed on the conductive layer 42. The insulating wall 43 may serve as a guide for plating growth, and may adjust a shape of an opening of the insulating wall 43 to control a cross-sectional shape of an ultimate coil. The insulating wall 43 needs to be formed to have a thickness greater than or equal to a planned thickness of a coil, such that the coil is easily formed. The material of the insulating wall 43 is not limited, but various materials may be used as long as they have insulating properties.

Figure 4E:
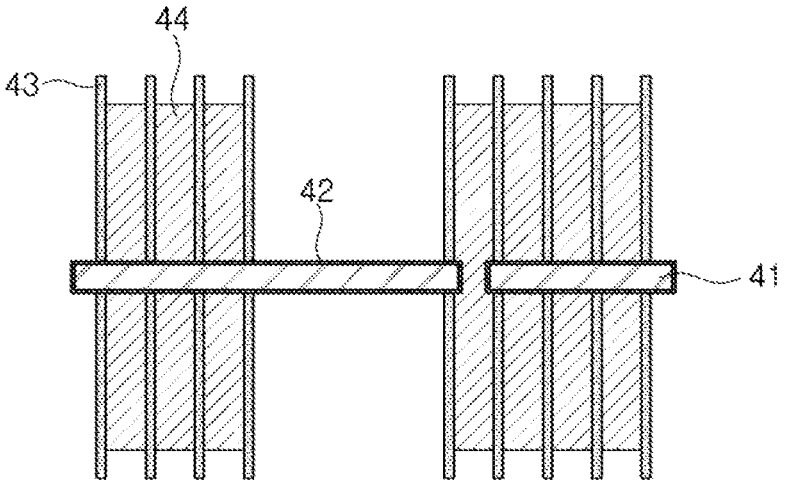

Referring to FIG. 4E, a plating layer 44 fills in the opening of the insulating wall 43 provided in FIG. 4D. In detail, the plating layer is a copper (Cu) plating layer, and the plating layer may be grown to a height or thickness lower than or even with a top surface of the insulating wall 43.

Figure 4F:
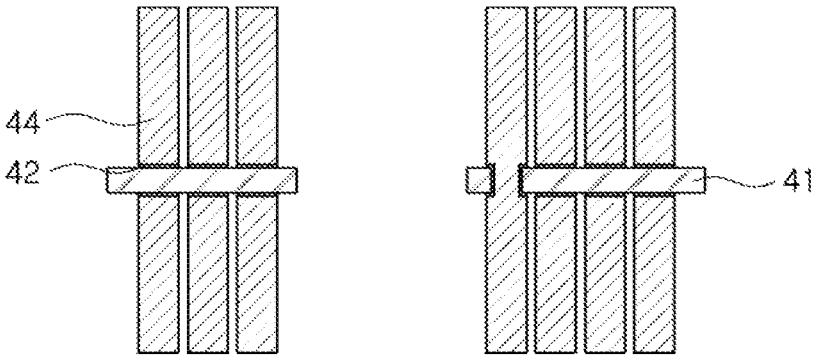

Referring to FIG. 4F, the insulating wall 43 is removed and the conductive layer disposed below the insulating wall 43 is removed to prevent short-circuiting from occurring between adjacent coils. A manner of removing the insulating wall 43 is not limited, and the insulating wall 43 may be removed by etching using a chemical or by physically using a $CO_2$ laser. In addition, a manner of removing the conductive layer disposed below the insulating wall 43 is not limited. When the conductive layer is a copper (Cu) layer, the conductive layer has a thickness of, in detail, 10 μm or less for $CO_2$ laser processing. When the conductive layer is a nickel (Ni) layer or a niobium (Nb) layer, there is no limitation in the thickness of the conductive layer.

Figure 4G:
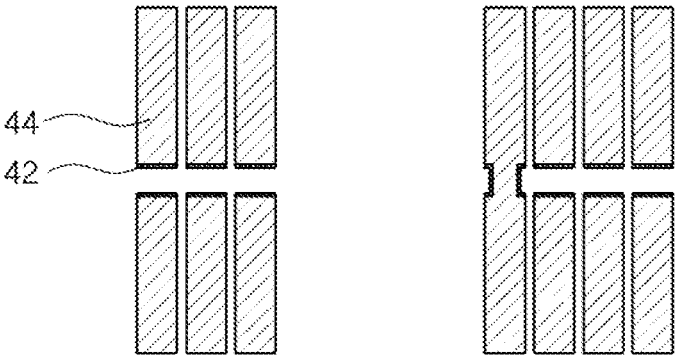

Referring to FIG. 4G, the insulating film 41 supporting a coil is removed. Only a cured insulating film is selectively dissolved by selecting a solvent which may dissolve the insulating film 41. Since the insulating film 41 is removed, the top coil and the bottom coil are connected to each other through a via, but a plane coplanar with the via is in a state of a void (e.g., the plane disposed between the top and bottom coils and coplanar with the via is devoid of any material).

Figure 4H:
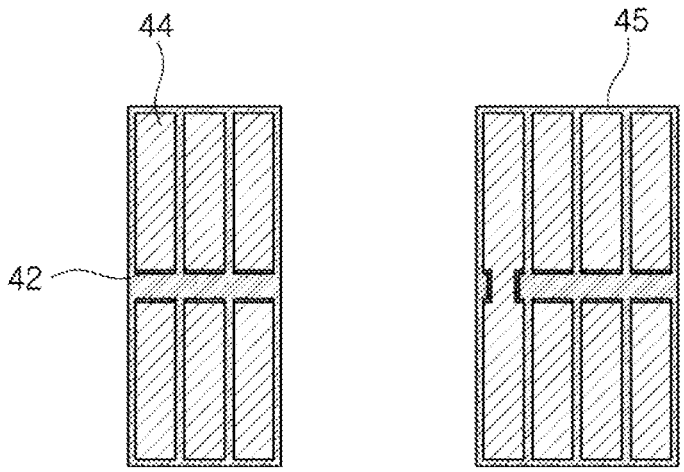

Referring to FIG. 4H, an insulating layer 45 is formed to cover exposed surfaces such as the surface of a top coil, the surface of a bottom coil, and the like. Chemical vapor deposition (CVD) is appropriate as a manner of forming the insulating layer 45. As a thickness of the insulating layer 45 increases, a void formed by removing the insulating film in FIG. 4G (e.g., the void disposed between the top and bottom coils and coplanar with the via) may be filled with the insulating layer. For example, an insulating layer covering a surface of an upper conductive layer and an insulating layer covering a surface of a lower conductive layer are integrated as a single body to substantially fill up the void.

Although not illustrated in detail, when an insulating layer covering the upper conductive layer and an insulating layer covering the lower conductive layer do not fill up the void, the insulating layers may be integrated as a single body by compressing the upper conductive layer and the lower conductive layer with a pressure to an extent that a via is not damaged.

Figure 4I:
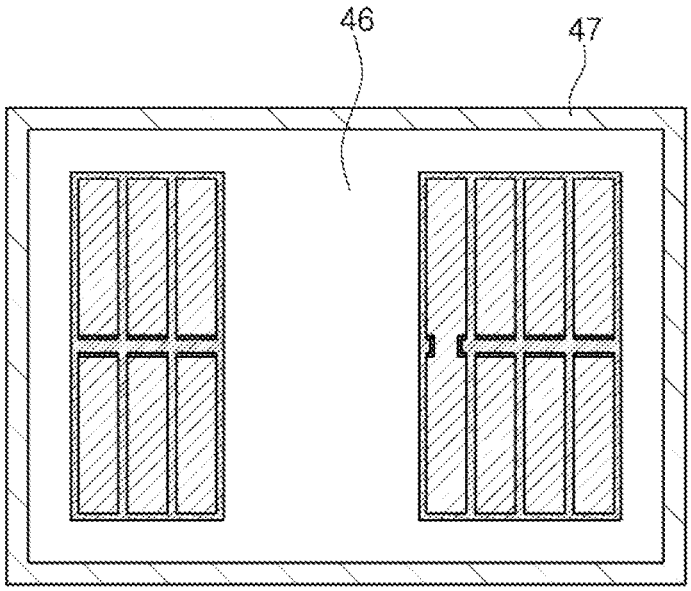

Referring to FIG. 4I, a finishing process is performed to form an encapsulant 46 to fill a coil in which the insulating layer is formed and to form an external electrode 47 to electrically connect the coil to an external component. Since the finishing process is substantially the same as a related-art finishing process, a detailed description thereof will be omitted.

Other than the above description, duplicate description of the above-described features of the coil component according to an exemplary embodiment will be omitted.

The present disclosure is not limited by the above-described embodiments and the appended drawings. Therefore, substitution, modification, and alteration of various forms can be made by those skilled in the art without departing from the scope of the present invention described in the claims, and this will also be within the scope of this disclosure.

In the meantime, a term "example" used in the present disclosure does not mean the same exemplary embodiment, but is provided in order to emphasize and describe different unique features. However, exemplary embodiments provided herein are considered to be able to be implemented by being combined in whole or in part with one another. For example, one element described in a particular exemplary embodiment, even if it is not described in another exemplary embodiment, may be understood as a description related to another exemplary embodiment, unless an opposite or contradictory description is provided therein.

Meanwhile, terms used in the present disclosure are used only in order to describe an example rather than limiting the scope of the present disclosure. In this case, singular forms include plural forms unless interpreted otherwise in context.

According to the exemplary embodiment, one of various effects of a coil component and a method for manufacturing the same is to implement a coil component with a low profile by removing a support member in a space between a top coil and a bottom coil.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil including a top coil and a bottom coil connected to each other through a via, the top coil is disposed on the bottom coil in a stacking direction; and an external electrode disposed on an external surface of the body to be connected to the coil, wherein a first insulating layer is disposed on a surface of the top coil, and a second insulating layer is disposed on a surface of the bottom coil, the first and second insulating layers extend continuously from the surfaces of the top coil and the bottom coil to between the top coil and the bottom coil in the stacking direction, respectively, a first metal layer is disposed on a bottom surface of the top coil and a top surface of the bottom coil, the first metal layer directly contacts a portion of at least one of the first or second insulating layer arranged between the top coil and the bottom coil in the stacking direction, and at least one of the first metal layer disposed on the bottom surface of the top coil or the top surface of the bottom coil is thinner than a distance between the top coil and the bottom coil.

2. The coil component of claim 1, wherein the first and second insulating layers are integrated as a single body between the top coil and the bottom coil.

3. The coil component of claim 2, wherein one or more of a thickness of the first insulating layer and a thickness of the second insulating layer are greater than half of the distance between the top coil and the bottom coil.

4. The coil component of claim 1, wherein the first and second insulating layers form a boundary, on which the first and second insulating layers are in contact with each other, between the top coil and the bottom coil.

5. The coil component of claim 4, wherein the first insulating layer has a thickness smaller than half of the distance between the top coil and the bottom coil, and the second insulating layer has a thickness smaller than half of the distance between the top coil and the bottom coil.

6. The coil component of claim 4, wherein a pore is formed on or beneath the boundary.

7. The coil component of claim 1, wherein each of the first insulating layer and the second insulating layer has a thickness of 5 micrometers or more to 15 micrometers or less.

8. The coil component of claim 1, wherein a space between the top coil and the bottom coil does not include an insulating material other than an insulating material forming the first insulating layer and the second insulating layer.

9. A coil component comprising:

a body including a top coil and a bottom coil connected to each other through a via, the top coil is disposed on the bottom coil in a stacking direction; and an insulating layer including a first insulating layer that directly contacts side surfaces of the top coil, and a second insulating layer that directly contacts side surfaces of the bottom coil, wherein the insulating layer integrally extends continuously from the side surfaces of the top and bottom coils, respectively, to between the top coil and the bottom coil in the stacking direction, a first metal layer disposed on a bottom surface of the top coil and a top surface of the bottom coil, the first metal layer directly contacts a portion of at least one of the first or second insulating layer arranged between the top coil and the bottom coil in the stacking direction, and at least one of the first metal layer disposed on the bottom surface of the top coil or the top surface of the bottom coil is thinner than a distance between the top coil and the bottom coil.

10. The coil component of claim 9, wherein the top coil includes a plating layer disposed above the first metal layer disposed on the bottom surface of the top coil, the first metal layer extends integrally along the via and the top surface of the bottom coil, and the plating layer extends integrally to the bottom coil through the via and below the first metal layer disposed on the top surface of the bottom coil.

11. The coil component of claim 9, wherein the first insulating layer integrally extends between windings of the top coil, and the second insulating layer integrally extends between windings of the bottom coil.

12. The coil component of claim 9, further comprising:

first and second external electrodes each connected to a respective one of the top and bottom coils; and an encapsulant, including a magnetic material, disposed between the insulating layer and the first and second external electrodes.

* * * * *